United States Patent [19]

Dollfus

[11] 4,264,284

[45] Apr. 28, 1981

[54] SELF-PRIMING CENTRIFUGAL PUMP AND SAFETY INSTALLATION THEREFOR

[75] Inventor: Jacques Dollfus, Saint Mande, France

[73] Assignee: Saint-Gobain Techniques Nouvelles, Courbevoie, France

[21] Appl. No.: 820,227

[22] Filed: Jul. 29, 1977

[30] Foreign Application Priority Data

Aug. 13, 1976 [FR] France ..... 76 24748

[51] Int. Cl.[2] ..... F04B 21/00

[52] U.S. Cl. ..... 417/313; 55/421; 417/360

[58] Field of Search ..... 417/89, 69, 360, 361, 417/313; 415/121 R, 121 G; 55/421, 437, 159, 315

[56] References Cited

U.S. PATENT DOCUMENTS

| | | | |
|---|---|---|---|
| 2,010,435 | 8/1935 | Matheson | 55/315 X |
| 2,181,973 | 12/1939 | Jasberg | 417/360 |
| 2,217,655 | 10/1940 | Bassett | 55/159 |
| 2,763,397 | 9/1956 | Rice | 137/206 X |
| 2,970,604 | 2/1961 | Henry | 137/206 |
| 4,039,305 | 8/1977 | Livesay | 55/159 |

FOREIGN PATENT DOCUMENTS

| | | | |
|---|---|---|---|
| 487686 | 11/1929 | Fed. Rep. of Germany | 417/360 |
| 1190794 | 4/1965 | Fed. Rep. of Germany | 417/360 |
| 1403839 | 11/1969 | Fed. Rep. of Germany | 417/360 |
| 2147140 | 3/1972 | Fed. Rep. of Germany | 417/360 |
| 2044994 | 2/1971 | France . | |

*Primary Examiner*—Carlton R. Croyle
*Assistant Examiner*—Edward Look
*Attorney, Agent, or Firm*—Pennie & Edmonds

[57] ABSTRACT

A self-priming centrifugal pump is disclosed with a vertical axis adapted for pumping harmful liquids. Such pump embodies fixed body means being closed at its lower end and having a widened upper portion which includes a truncated cone surface. The widened portion acts as a seat. The pump envisions removable means which includes a pump wheel, a cage, and a driving motor with a shaft for the pump wheel and which rests on the seat. The cage of the wheel being provided with at least three generally horizontal partitions which define in conjunction with the pump body a lower suction chamber, a middle delivery chamber, and an upper venting chamber, said suction, delivery and venting chambers being, respectively, connected to a suction pipe, a delivery pipe, and a venting pipe adapted to be connected to an apparatus for the treatment of gases substantially at atmospheric pressure. Also contemplated are sealing means including three separate and generally annular sealing members, each being connected to a corresponding one of said partitions and each separately resting on the seat of said pump body, and an internal lining means between the motor shaft and the upper one of said partitions of said venting chamber for providing fluid tightness between the chambers and the pump body. A safety installation adapted for use in pumping dangerous liquid substances comprises, in combination, protective walls defining an enlarged enclosure, a removable plug member in at least one wall having an opening closeable thereby and having a central aperture therethrough. The installation embodies a centrifugal self-priming pump means having a fixed pump body and removable means operatively connected to said body for pumping liquids and being situated within the protective walls; gas treatment means operatively connected to the pump; means connected to the upper part of the pump and intermediate the pump and the gas treatment means for separating gas from the pumped liquid; and means connected to the pump means through the aperture in the removable plug and operatively connected exteriorly of the protective walls for forcing the removable means downwardly into tighter engagement with the pump body.

15 Claims, 8 Drawing Figures

SELF-PRIMING CENTRIFUGAL PUMP AND SAFETY INSTALLATION THEREFOR

BACKGROUND OF THE INVENTION

1. Field of the Invention

This invention relates to self-priming centrifugal pumps and safety installations therefor.

2. Brief Description of the Prior Art

In nuclear pumping installations, for example, all of the apparatus which process highly radioactive and very toxic liquids and those which are designed to reprocess irradiated fuels, are surrounded with protective screens. Such screens essentially serve to stop the radiation and prevent the dissemination of radioactive and toxic gases and aerosols into the working zone where personnel are present.

Furthermore, in order to facilitate maintenance operations of this enclosed cell apparatus, precautions are taken so as to limit, as much as possible, contamination of the internal walls of the protective cell and the external walls of the apparatus contained thereby. The apparatus and, in particular, the tanks are, for example, entirely closed and their vent-holes are connected by air-tight pipes to installations for the monitoring and treatment of the gaseous effluents.

In order to eliminate leak hazards in the lower parts of the installation, for example, welded assemblies are compulsory and assemblies provided with flanges are forbidden. Accordingly, the installation of centrifugal pumps at the bottom of the tanks is, therefore, not possible, and it is for this reason that self-priming centrifugal pumps have been operating for the past few years.

The installation of such pumps is above the draw tanks and this conforms more satisfactorily to existing safety standards and, moreover, facilitates maintenance operations.

French Pat. No. 1,344,957 issued to applicant describes a self-priming centrifugal pump. The pump is described as having a vertical axis and comprises a body separated on the inside by a partition into two superimposed communicating chambers. The lower chamber is connected to a suction pipe and the upper chamber to a delivery pipe. This pump has a centrifugal wheel located between the two chambers which is driven about the vertical axis and is controlled by a motor located above the enclosure. Such wheel comprises a horizontal plate provided on each of its faces with a series of blades or fins, the respective dimensions of which are determined so that the dynamic pressure created by the fins of the internal face of the plate will be lower than that created by the fins of the upper face. A pipe issuing at a short distance from the bottom of the lower chamber puts it into communication with the central part of the region located below the lower face of the wheel plate, and a pipe surrounds the driving axis and pulls it into communication the central part of the region located above the upper face of the plate with the outside of the body of the pump.

The rotation of the centrifugal wheel ensures, under these conditions, the transfer of the liquid from the lower chamber or suction chamber to the upper chamber or delivery chamber by means of the fins provided on the lower face of the plate while preserving, by means of the fins of the upper face, the tightness between the external atmosphere and the delivery chamber without the use of static joints and/or a stuffing-box. Indeed, the fluid seal in this instance consists of the liquid itself, under the action of the centrifugal force due to the fins provided on the upper part of the plate forming a stable ring which is maintained between these fins and the pipe surrounding the drive shaft.

Fench addition Pat. No. 88,688 to the above-noted French patent relates to various improvements introduced into a self-priming pump of the previously described type. In particular, the pump includes blades providing a vacuum pump operation during the priming phase, one or more communication ports between the suction chamber and the delivery chamber in order to preserve, at shut-off time, a sufficient quantity of liquid for the following start-up, and a device for effecting the connection to the pipes which also provides for disassembly at a distance.

Furthermore, German Pat. No. 1,190,794 discloses a centrifugal pump with a vertical axis which can be easily disassembled due to the fact that it comprises a fixed bowl shaped body, closed on its lower part and enlarged in the form of a frustum on its upper part. It is described that the enlarged part acts as a seat for a removable block which comprises the pump wheel and its cage, as well as a motor for driving the pump.

However, the use of these pumps still has several drawbacks. For instance, tightness is only completely attained during operation. Consequently, under non-operating conditions, a certain quantity of air containing radioactive aerosols can leave the pump during the start-up or shut-off periods.

Moreover, in installations for the reprocessing of irradiated fuels and, in particular, for the so-called PUREX process, which is the most often utilized, organic solvents, such as tributyl phosphate, are used. The surface tension of such types of solvents, however, in the presence of air is much greater than that of water. Accordingly, this relationship prevents the self-priming pumps of the known type from pumping the above-described solvents because a very stable foam is formed at start-up which prevents operation. What is, however, more serious is the fact that even a small quantity of solvent even whenever accidentally mixed with an aqueous solution, which normally does not contain it, is enough to prevent start-up.

SUMMARY OF THE INVENTION

An object of this invention is to overcome the above-mentioned drawbacks.

Broadly, in accordance with the spirit and scope of the invention, there is envisioned a self-priming centrifugal pump with a vertical axis adapted for pumping harmful liquids. Such pump embodies fixed body means being closed at its lower end and having a widened upper portion which includes a truncated cone surface. The widened portion acts as a seat. The pump envisions removable means which includes a pump wheel, a cage, and a driving motor with a shaft for the pump wheel and which rests on the seat. The cage of the wheel being provided with at least three generally horizontal partitions which define in conjunction with the pump body a lower suction chamber, a middle delivery chamber, and an upper venting chamber, said suction, delivery and venting chambers being, respectively, connected to a suction pipe, a delivery pipe, and a venting pipe adapted to be connected to an apparatus for the treatment of gases substantially at atmospheric pressure. Also contemplated are sealing means including three separate and generally annular sealing members each being connected to a corresponding one of said partitions and each separately resting on the seat of said pump body, and an internal lining means between the motor shaft and the upper one of said partitions of said venting chamber for providing fluid tightness between the chambers and the pump body. A safety installation adapted for use in pumping dangerous liquid substances comprises, in combination, protective walls defining an enlarged enclosure, a removable plug member in at least one wall having an opening closeable thereby and having a central aperture therethrough. The installation embodies a centrifugal self-priming pump means having a fixed pump body and removable means operatively connected to said body for pumping liquids and being situated within the protective walls; gas treatment means operatively connected to the pump; means connected to the upper part of the pump and intermediate the pump and the gas treatment means for separating gas from the pumped liquid; and means connected to the pump means through the aperture in the removable plug and operatively connected exteriorly of the protective walls for forcing the removable means downwardly into tighter engagement with the pump body.

BRIEF DESCRIPTION OF THE DRAWINGS

The invention will now be described in detail with reference to the accompanying drawings wherein.

DETAILED DESCRIPTION

Figure 1:
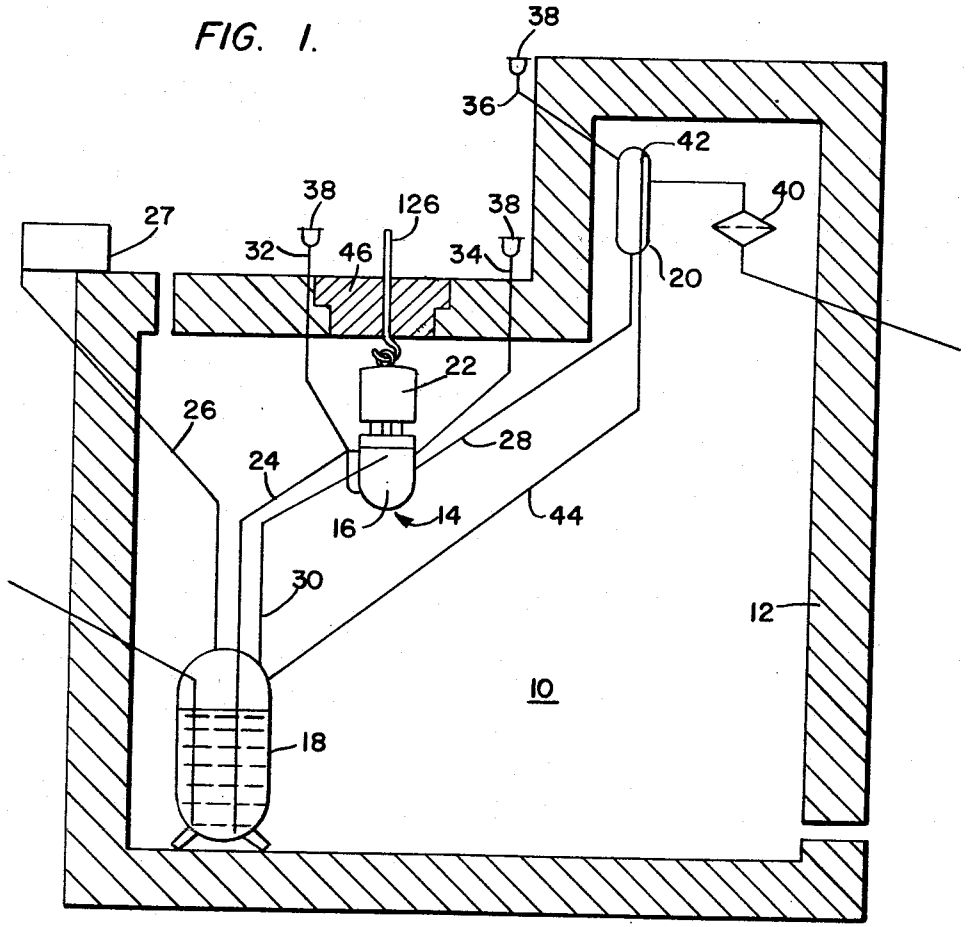
FIG. 1 is a diagrammatic view illustrating a safety installation employing a self-priming centrifugal pump enclosed therein.

With reference to FIG. 1, the radioactive liquid pumping installation according to the invention essentially comprises an enclosure 10 which is generally inaccessible to personnel and surrounded by protective walls 12. A self-priming centrifugal pump 14, made in accordance with the spirit and scope of this invention, having a vertical axis is shown which is comprised of a body or bowl 16 set at a height which is greater than that of a drawing tank 18 and at a height which is lower than that of the point of arrival of the liquid, for example a container 20; and a removable block means 22 resting on body 16.

Body 16 of the pump is connected by a suction pipe 24 to the draw tank 18 having a gas roof which is connected by a pipe 26 to a ventilation or gas treatment network 27 which serves as a gas treatment means such as a gas filter. A delivery pipe 28 connects the body 16 to the container 20 to be supplied. Furthermore, a venting pipe 30 connects the upper stage of the pump body 16 to the roof of the draw tank 18. Finally, several conventional filling, draining, cleaning and decontamination pipes 32, 34, 36 for body 16 and container 20 lead into the inside of enclosure 10 and are sealed by safety stoppers identified by reference numeral 38.

When a pressurized apparatus, such as a filter 40, is to be supplied, the operation of which would be disturbed by the presence of air in the liquid it receives, there is provided intermediate or liquid-gas separator container 20. The container 20 is interposed between the delivery port of body 16 and filter 40 and includes an overflow or calibrated port 42 which is connected by a descending pipe 44 to the roof of draw tank 18. The container 20 functions in a known manner to prevent filter 40 from being adversely affected by gas in the liquid it receives.

The removable block means 22 of the pump, which is removably placed in the fixed body 16 can be disassembled from the top thereof and can be removed from the enclosure 10 through an opening which is normally closed by a plug 46. The plug 46 as will be subsequently explained forms a trap.

Figure 2:
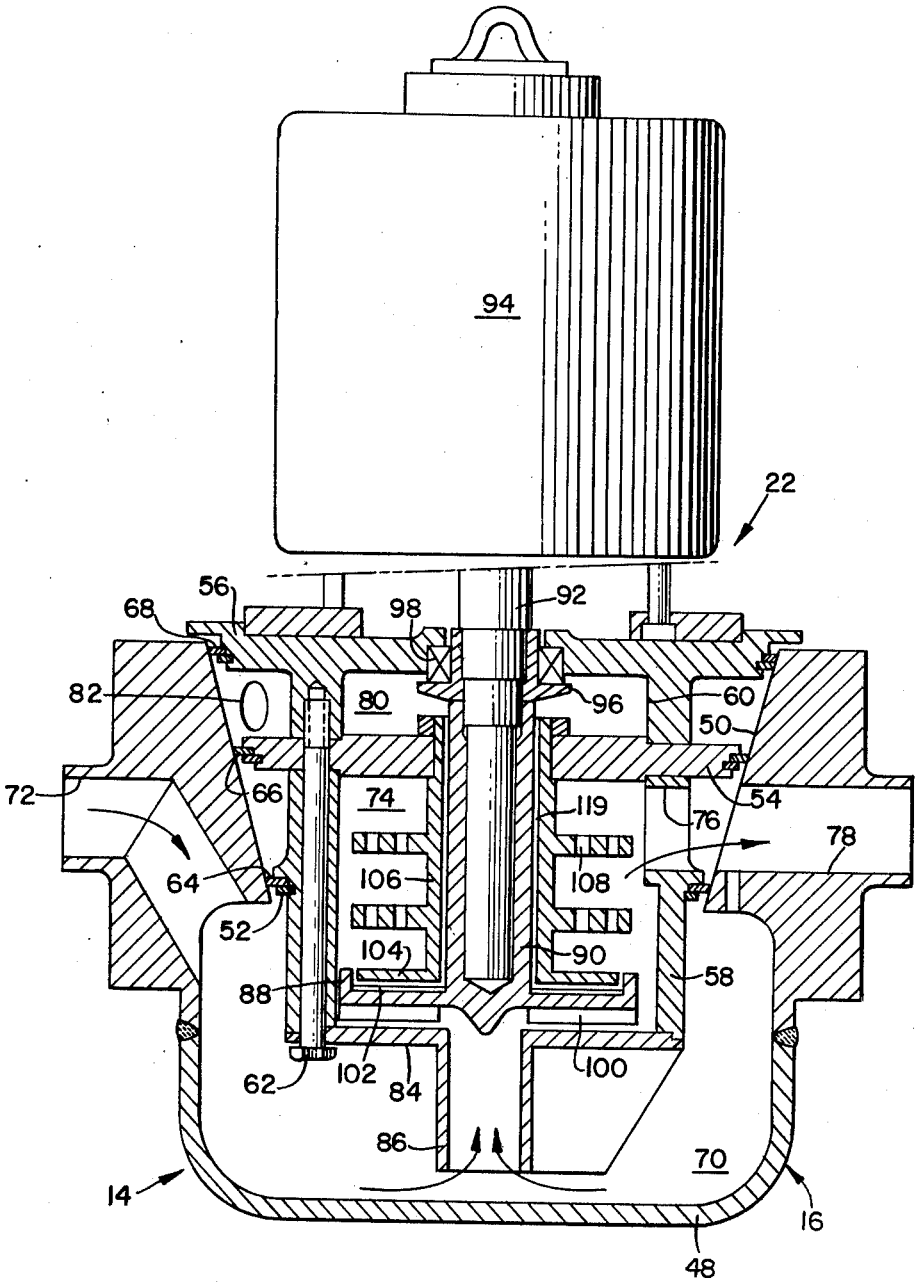
FIG. 2 is a sectional view of the novel and improved centrifugal pump embodying the principles of the invention.

FIG. 2 shows in detail the self-priming pump according to the invention. In particular, the pump body 16 is stationary and comprises a bottom 48 at its lower end and a widened, generally truncated cone-like surface 50 at its upper end. The widened end or cone surface 50 receives the removable block means 22. The stator of the removable block means 22 comprises three horizontal partitions 52, 54 and 56 maintained at predetermined spacings by cylindrical cages 58 and 60 provided with barrels or locking recesses in which are screwed tightening braces 62.

Generally, annular and conventional fluid sealing members or joints 64, 66 and 68 are set all around the peripheral edges of the horizontal partitions 52, 54 and 56, respectively, in order to provide a tight contact with the truncated shaped wall 50 of body 16. Partitions 52, 54, and 56, respectively, define in body 16 a lower suction chamber 70 connected to the suction pipe 24 through port 72, a middle delivery chamber 74 connected to the delivery pipe 28 through radial openings 76 pierced in the lateral wall of the lower cage 58, and through orifice 78 of body 16, and an upper venting chamber 80 connected to the venting pipe 30 through a port 82. A filling, rinsing or decontamination pipe, not shown, might possibly be provided which issues into the suction chamber 70 and which is designed to supply make-up liquid for starting up or to effect a rinsing operation in the pump body 16 of pump 14. It is best shown in FIG. 2 that the delivery chamber 74 is mounted concentrically with respect to the hub 90 of wheel 88.

The lower cylindrical cage 58 is closed by generally circular bottom plate 84 which has a downwardly extending neck 86. Above bottom plate 84 of cage 58 there is a pump wheel 88. The wheel 88 is provided with a hollow vertical hub 90 in which is set shaft 92 of a driving motor 94 fixed integral with the upper partition 56. The hub 90 of pump wheel 88 which is made of corrosion resistant material extends up into the venting chamber 80, where it is provided with a deflecting ring 96. The deflecting ring 96 is spaced from upper portion 56 with a rotating seal joint or internal lining 98 interposed therebetween. Thus, accidental ingress of liquid is prevented from penetrating into motor 94, and a coupling shaft, which can be made from a material having high mechanical qualities but not necessarily high corrosion resistance. Accordingly, protection is provided. Joint 98 is not subjected to any appreciable pressure differences due to the fact that both its faces are approximately at atmospheric pressure and for that reason it can have a long life.

A detailed description of wheel 88 will be found in the aforedescribed French Pat. No. 1,344,957, as well as its first certificate of addition No. 88,688. Accordingly, a detailed description need not be given. It should be pointed out, however, that the wheel 88 is provided on its lower face with blades 100 having a special profile, and on its upper face with radial blades 102. Fins 102 rotate with a small clearance in front of a fixed plate 104 connected by a vertical neck 106 to the middle partition 54.

The annular space 119 between hub 90 and neck 106 connects chamber 80 and the central part of the wheel for blades 102. Thus, during the start-up and operating periods of the pump, the pressure in chamber 80 is less than that of enclosure 10, which eliminates any possibility of aerosol transport from chamber 80 to enclosure 10. Neck 106 has perforated fixed discs 108, designed to restrain convection movements of the liquid therein and to enhance the coalescence of the bubbles which form as a result of the type pumping action occuring. It being understood that the foregoing pump can pump foaming liquids.

Figure 4:
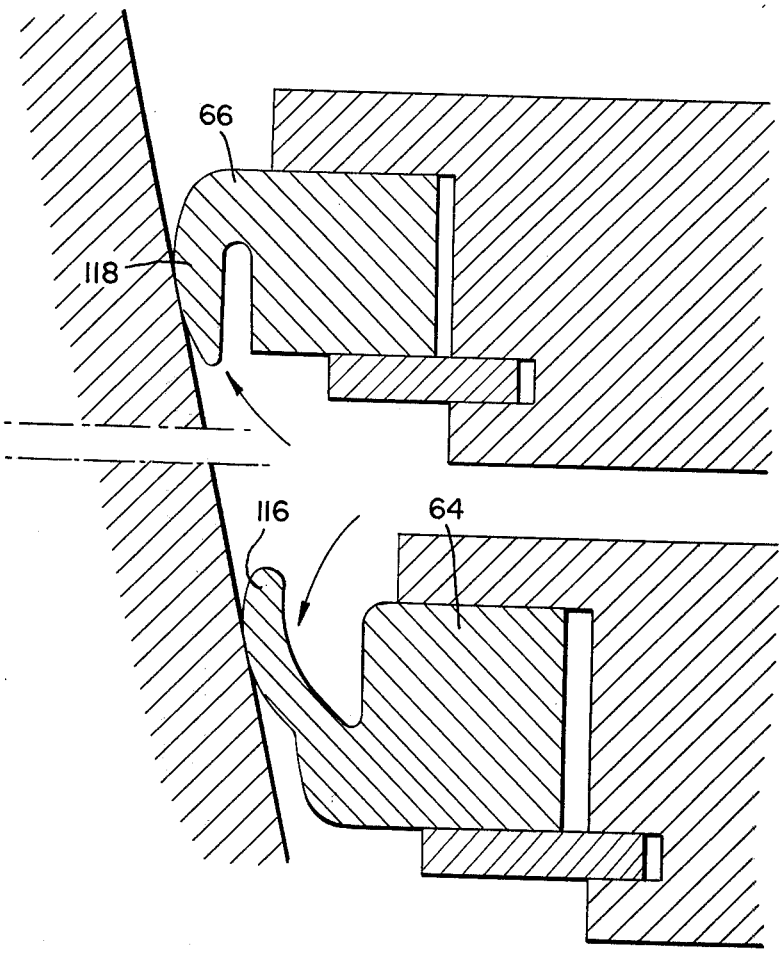
FIG. 4 is another embodiment illustrating a partial and enlarged sectional view of the lower part of the contact zone between the wheel cage and pump body.

As already specified, sealing joints 64, 66 and 68 guarantee tightness between chambers 70, 74 and 80, and the inside of enclosure 10 (FIG. 1). In fact, a deficiency in the tightness of joints 64 and 66 would not in any way endanger the personnel since any leak of, for example, radioactive liquids towards the venting chamber 80 would immediately be recovered by draw tank 18. On the other hand, serious dangers might result from a deficiency in the tightness of joint 68, since the exterior of the pump 14 and interior walls 12 of enclosure 10 might, indeed, be contaminated by active products which would require a long and difficult decontamination process. Furthermore, toxic aerosols carrying plutonium might be disseminated. The present invention overcomes such deficiencies. It is for this reason that particular care must be given to setting up the conditions which provide for the tightness of seal joint 68. In the embodiment shown in FIG. 2, for example, the three joints 64, 66 and 68 are tightly pressed onto the truncated cone-shaped wall 50 by the resultant force equal to the weight of the removable block 22 which is decreased by the upward thrust of pressure resulting from the delivery chamber 74, and to the difference in surface areas of partitions 52 and 54. In order to preferentially provide for the tightness of seal joint 68, seal joints 64 and 66 are made of a material which is more flexible than that of joint seal 68 which, therefore, supports alone the major part of the resultant. The same result can be obtained, as shown in FIG. 4, by providing seal joints 64 and 66 with lips 116 and 118 turned upwardly and downwardly, respectively. The increase in flexibility due to these lips 116 and 118 makes it possible to use the same material for all three seal joints 64, 66 and 68.

Figure 3:
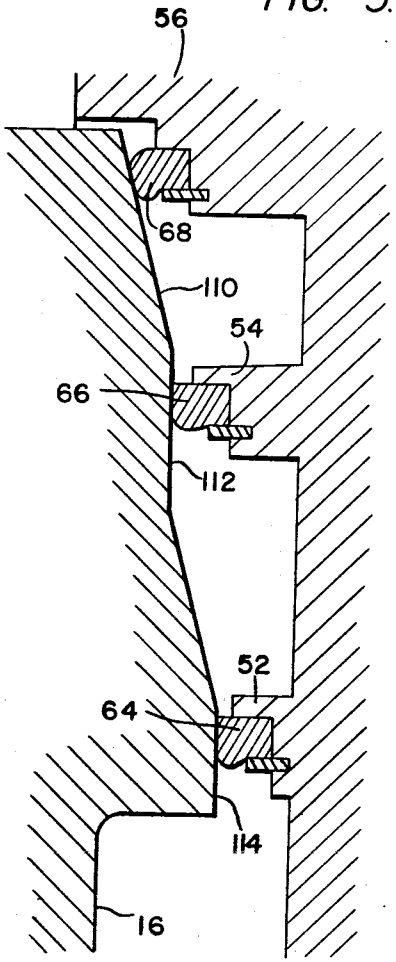
FIG. 3 shows an enlarged and partial view of a contact zone between a wheel cage and pump body of a second embodiment of the novel and improved centrifugal pump.

In the embodiment as best shown in FIG. 3, the widened wall of the body pump 16 has an upper wall surface shaped as a truncated cone 110 on which bears joint seal 68 and two generally vertical walls 112 and 114 having diameters equal, respectively, to the inside diameters of annular joints 64 and 66. As a result thereof, the seal joint 68 alone supports almost the entire resultant force.

Figure 5:
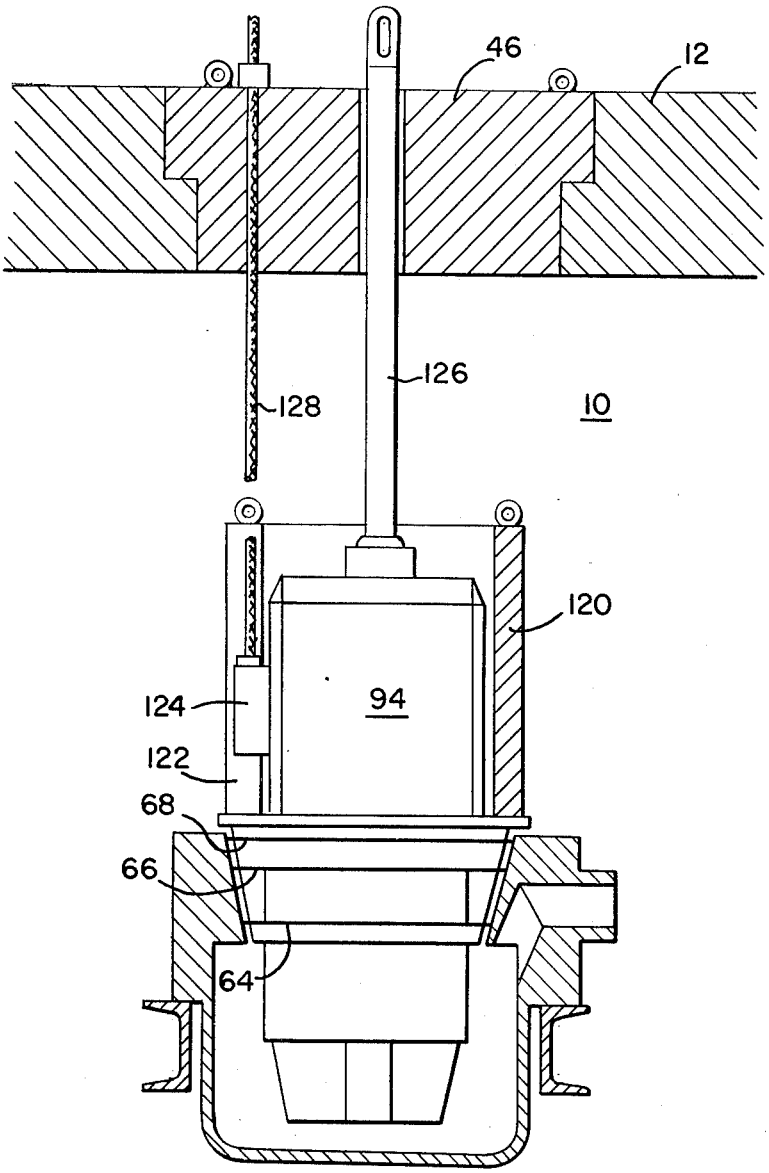
FIG. 5 is a schematic view showing the pump according to the invention provided with a ballast member on a removable block.
Figure 5A:
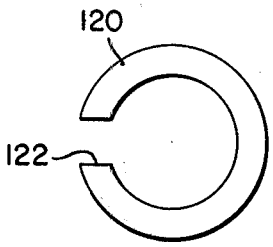
FIG. 5*a* shows a plan view of the ballast member depicted in FIG. 5.

When the resultant force is not sufficient for joint 68 to ensure tightness with the widened wall 110, it is necessary to increase the weight. For that purpose, a ballast weight 120 can be used which is set around motor 94, as shown in FIG. 5 and rests on partition 56. Weight 120 is cylindrical and comprises a longitudinal slit 122 in order to allow terminal box 124 of the motor to fit therein.

As also shown in FIG. 5, there is a vertical lifting rod 126 which goes through plug 46 of enclosure 10 and is suitably attached to motor 94. An electric cable 128 connects the terminal box 124 to an external source of current through plug 46 of the enclosure. The process for lifting the removable block 22 will be explained below.

Figure 6:
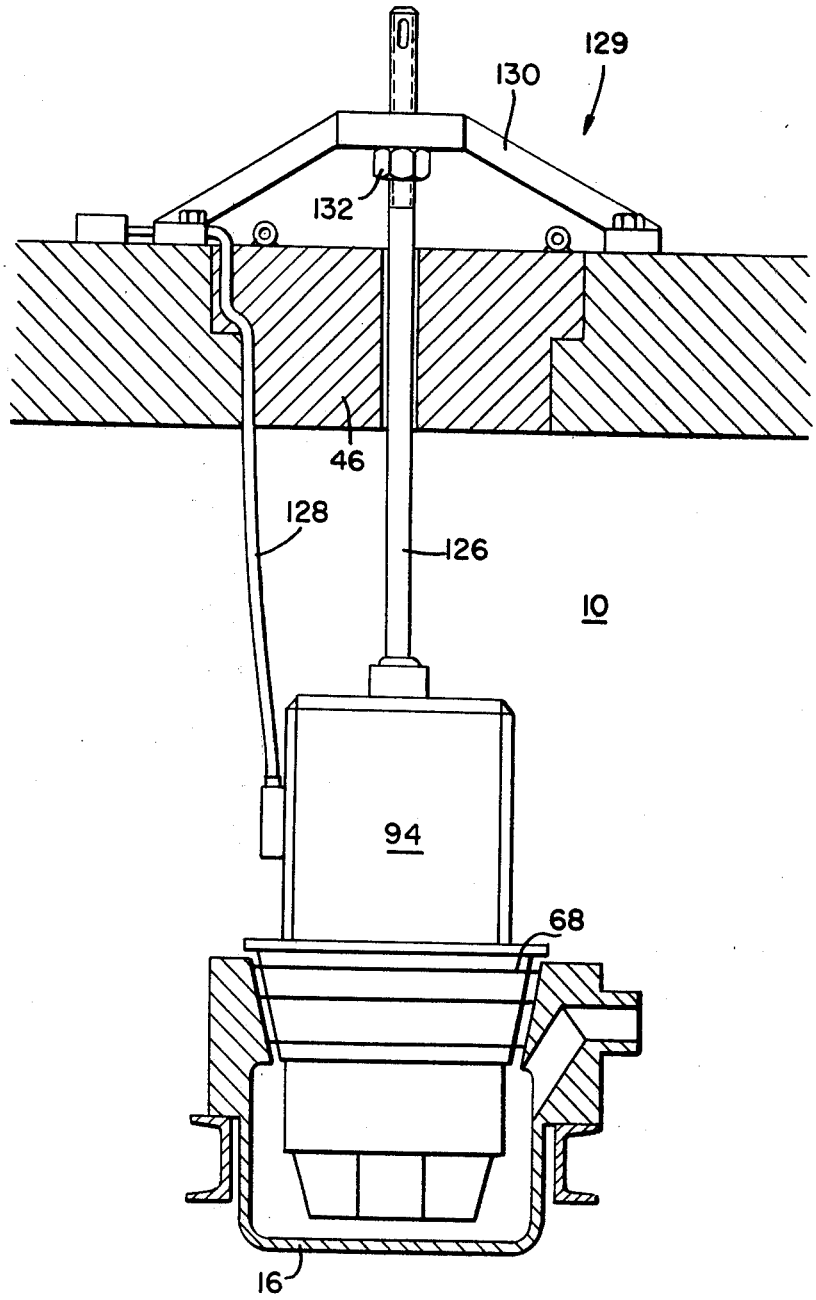
FIG. 6 is a schematic view showing the apparatus which is designed to urge the removable block on the pump body.

The force exerted on seal joint 68 can also be increased by using, in a known manner, the thrust mechanism 129 perhaps best illustrated in FIG. 6. Such mechanism essentially comprises a stirrup-piece 130 fixed to the outside of enclosure 10 and on which bears lifting rod 126. At the end part of the rod 126, a blocking nut 132 is screwed on and which bears below the stirrup-piece 130 so that the removable assembly is forced downwardly, bearing on the pump body 16. Rod 126 and nut 132 form a screw jack which can be replaced, without departing from the spirit and scope of the invention, by a pneumatic or hydraulic jack.

Figure 7:
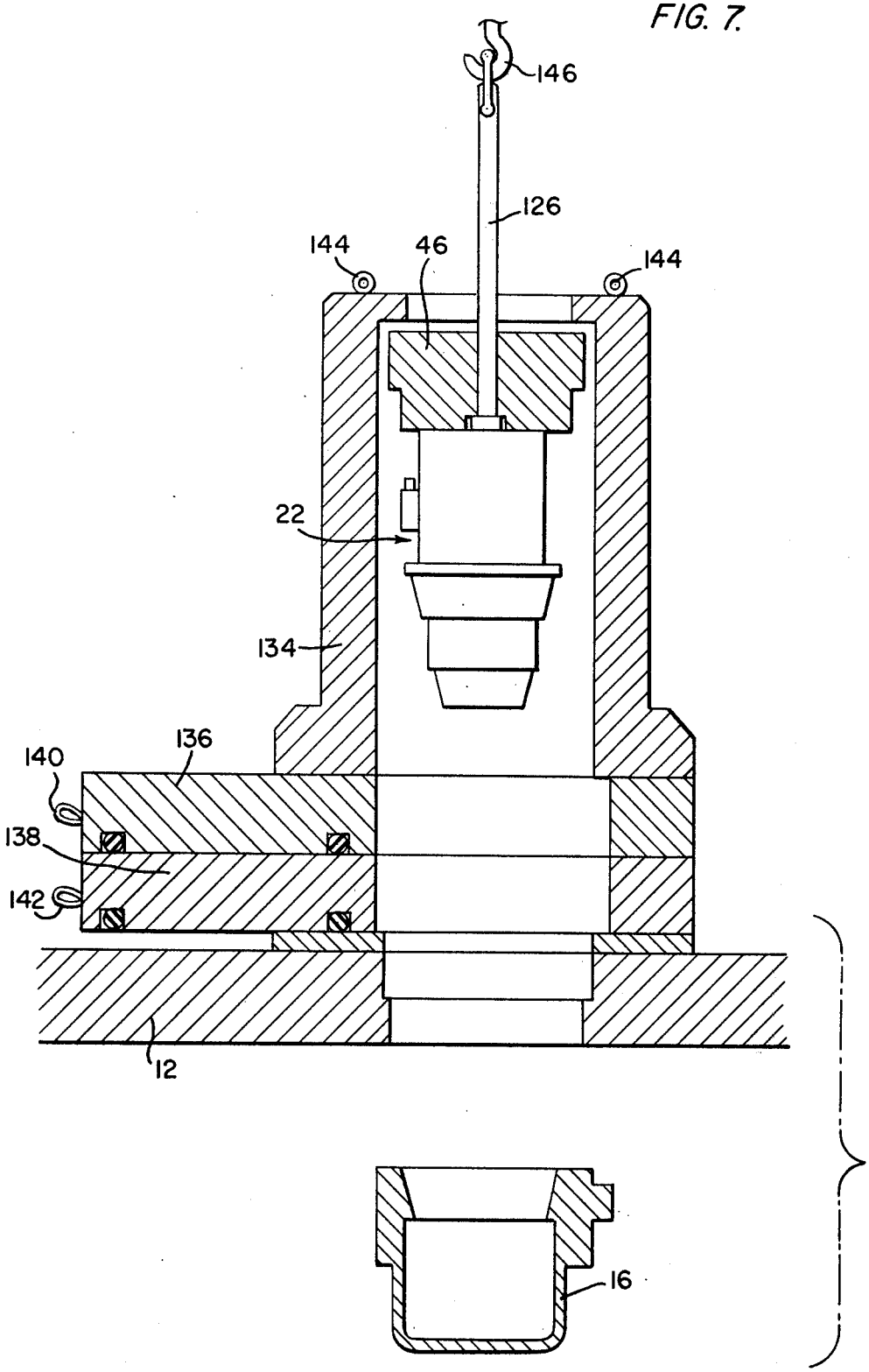
FIG. 7 shows a sequence in the removal process of the removable block under the protection of a shielded member.

FIG. 7 illustrates the disassembly operation of removable block 22. To this effect, a lead tower 134 is used, the bottom of which consists of two laterally retractable and superimposed traps 136 and 138 which can be made to slide by pulling on hooks 140 and 142. The lead tower 134 includes at its top hooks 144 for manipulation thereof.

To disassemble the removable block 22, the electric cable is disconnected from the outside and the lead tower 134 is positioned on plug 46. Traps 136 and 138 are then opened and hook 146 of a suitable manipulation apparatus (not shown) is hooked to the end part of the lifting rod 126. Removable block 22 and plug 46 are then lifted up until they are brought inside the lead tower 134. Traps 136 and 138 are then closed again with the latter serving as a replacement for plug 46 from the standpoint of providing radiation protection. The lead tower 134 and its upper trap 136 are then removed so as to transport the entire assembly into appropriate premises where the mechanical block can be repaired.

Before disassembly, a rinsing operation of the pump can be effected through pipes 32 and 34 provided to this effect as shown in FIG. 1.

The pump according to the invention is very sturdy and is made using machined, forged or laminated parts having simple and standardized shapes.

It is apparent that by virtue of the foregoing described structure, there is provided a centrifugal pumping device and safety installation which ensures the return, through airtight pipes in the drawing tank, the gas roof of which is connected to a gas treatment installation, of all radioactive and toxic gases and aerosols present in the pump, and in the delivery pipe without any possibility for them to leave the installation and contaminate the cell or penetrate into an apparatus such as a pressurized filter which cannot function to their presence.

Towards this particular end, the pump according to the invention is characterized in that the cage of the pump wheel 88 is provided with horizontal partitions 108 which define, with the pump body 16, a lower suction chamber 70, a middle delivery chamber 74, and an upper venting chamber 80, which are respectively connected to a suction pipe 24, a delivery pipe 28, and a venting pipe 30 connected to a gas treatment apparatus substantially at atmospheric pressure. The tightness between these various chambers and the pump body being provided by the three annular joints 64, 66 and 68 which rest on the seat shaped as a truncated cone 50 and by an internal lining 98 set between the motor shaft and the upper partition of the venting chamber.

Since all the pipes are set in the stationary pump body 16, the removable block 22 can easily be moved into place or removed by simple vertical displacement without it being necessary to use any tightening means or disassemble the pipes. According to the invention, in order to ensure total tightness of the seal joints, the weight on the removable block 22 is increased by any appropriate means, for example, by placing a heavy mass around the removable block.

This invention also provides an antiemulsion device which, in the middle chamber coalesces and separates the gas bubbles from the liquid which are emulsified into the liquid by the pump wheel 88 during start-up.

While the invention has been described in connection with the preferred embodiments, it is not intended to limit the invention to the particular forms set forth above, but, on the contrary, it is intended to cover such alternatives, modifications, and equivalents as may be included within the spirit and scope of the invention as defined by the appended claims.

What is claimed is:

1. A self-priming centrifugal pump with a vertical axis adapted for pumping harmful liquids having fixed body means being closed at its lower end and having a widened upper portion which includes a truncated cone surface and acts as a seat; removable means including a pump wheel, a cage, and a driving motor with a shaft for the pump wheel and which rests on said seat, the cage of the wheel being provided with at least three generally horizontal partitions which define in conjunction with the pump body a lower suction chamber, a middle delivery chamber, and an upper venting chamber, said suction, delivery and venting chambers being, respectively, connected to a suction pipe, a delivery pipe, and a venting pipe adapted to be connected to an apparatus for the treatment of gases substantially at atmospheric pressure; and sealing means including three separate and generally annular sealing members, each being connected to a corresponding one of said partitions and each separately resting on said seat of said pump body, and an internal lining means between the motor shaft and the upper one of said partitions of said venting chamber for providing fluid tightness between said chambers and said pump body.

2. A pump according to claim 1 wherein the bottom two sealing members are made of a material which is relatively more flexible than that of the upper sealing member.

3. A pump according to claim 2 wherein each one of the two bottom sealing members are comprised of a generally deformable lip.

4. A pump according to claim 2 wherein said delivery chamber is mounted concentrically with respect to the pump wheel and said removable means include at least one fixed horizontal disc pierced with holes which enhances coalescence of foam.

5. A pump according to claim 1 wherein the upper sealing member rests on the truncated shaped seat, and the remaining lower two sealing members are in tight peripheral contact with vertical walls of said upper body part.

6. A pump according to claim 5 wherein each one of the two bottom sealing members are comprised of a generally flexible deformable lip.

7. A pump according to claim 1 wherein means are operatively connected to the top of said removable means to force at least one of said sealing members into tight engagement with said seat.

8. A pump according to claim 7 wherein said forcing means is a heavy mass placed on said removable means.

9. A pump according to claim 7 wherein said forcing means includes a rod and a thrust mechanism having a stirrup-piece fastened on the outside of an enclosure for the pump and a blocking nut threaded on the rod to form a screw jack.

10. A safety installation adapted for use in pumping dangerous liquid substances comprising, in combination, protective walls defining an enlarged enclosure, a removable plug member in at least one wall having an opening closeable thereby and having a central aperture therethrough; a self-priming centrifugal pump means having a fixed pump body and removable means operatively connected to said body for pumping liquids and being situated within the protective walls; gas treatment means operatively connected to said pump; means connected to the upper part of said pump and intermediate said pump and said gas treatment means for separating gas from the liquid being pumped; means connected to said pump means through said aperture in said removable plug and operatively connected exteriorly of the protective walls for forcing said removable means downwardly into tighter engagement with said pump body; and assembly means having an enclosed lead receptacle sized to receive therein the removable means and connected to the exterior of the closure and surrounding the removable plug assembly such that upward lifting of said removable means will sequentially lift the removable plug from the enclosure and enable the removable means to be brought within the receptacle.

11. The safety installation of claim 10 where said downward forcing means is comprised of a heavy mass placed on said removable means.

12. The safety installation as set forth in claim 10 wherein said means for forcing downwardly on said removable means is defined by a rod extending through the plug aperture, and a thrust mechanism comprising a stirrup-piece fastened on the outside of the enclosure and a blocking nut on the rod which forms with the rod a jack screw.

13. A system as set forth in claim 10 wherein said pump is connected to decontamination pipes connected to the outside of the enclosure.

14. The system as set forth in claim 10 wherein said self-priming centrifugal pump is confined in the enclosure at a level above the liquid which is to be pumped and which is contained in a draw tank, said fixed body being closed at its lower part and widened in the form of a truncated cone at its upper part, said widened part acting as a seat for said removable means, said removable means including the pump wheel and its cage and the driving motor for the pump, the cage of the wheel being provided with three generally horizontal partitions which define in conjunction with the pump body a lower suction chamber, a middle delivery chamber, and an upper venting chamber, said suction, delivery and venting chambers being, respectively, connected to a suction pipe, a delivery pipe, and a venting pipe adapted to be connected to an apparatus for the treatment of gases substantially at atmospheric pressure; sealing means including three separate and generally annular sealing members, each being connected to a corresponding one of said partitions and each separately resting on the seat of said pump body, and an internal lining means between the motor shaft and the upper one of said partitions of said venting chamber for providing fluid tightness between the chambers and the pump body.

15. The system as set forth in claim 14 wherein said means connected to the upper part of said pump is connected to the upper end of the delivery pipe and is a liquid-gas separator, the gas roof of which is connected to a gas treatment apparatus.

* * * * *